US011840669B2

(12) United States Patent
Minamoto et al.

(10) Patent No.: US 11,840,669 B2
(45) Date of Patent: Dec. 12, 2023

(54) METHOD FOR HYDROCARBON PRODUCTION, PURIFICATION METHOD, AND PURIFIER

(71) Applicant: KURARAY CO., LTD., Okayama (JP)

(72) Inventors: Naoya Minamoto, Ibaraki (JP); Katsuji Ujita, Tokyo (JP); Takuo Tsuruta, Tokyo (JP)

(73) Assignee: KURARAY CO., LTD., Okayama (JP)

( * ) Notice: Subject to any disclaimer, the term of this patent is extended or adjusted under 35 U.S.C. 154(b) by 259 days.

(21) Appl. No.: 17/414,141

(22) PCT Filed: Nov. 6, 2019

(86) PCT No.: PCT/JP2019/043565
§ 371 (c)(1),
(2) Date: Jun. 15, 2021

(87) PCT Pub. No.: WO2020/129446
PCT Pub. Date: Jun. 25, 2020

(65) Prior Publication Data

US 2022/0041942 A1 Feb. 10, 2022

(30) Foreign Application Priority Data

Dec. 21, 2018 (JP) ..... 2018-239916

(51) Int. Cl.

| | |
|---|---|
| ***C10G 29/24*** | (2006.01) |
| ***C10G 29/06*** | (2006.01) |
| ***C10G 29/20*** | (2006.01) |
| ***C10L 3/10*** | (2006.01) |

(52) U.S. Cl.
CPC ..... *C10G 29/24* (2013.01); *C10L 3/103* (2013.01); *C10L 2290/544* (2013.01); *C10L 2300/20* (2013.01)

(58) Field of Classification Search
None
See application file for complete search history.

(56) References Cited

U.S. PATENT DOCUMENTS

| | | | |
|---|---|---|---|
| 1,991,765 | A | 2/1935 | Marks |
| 4,680,127 | A | 7/1987 | Edmondson |
| 2017/0081597 | A1 | 3/2017 | Fuji et al. |
| 2018/0010056 | A1 | 1/2018 | Suzuki et al. |
| 2018/0312410 | A1 | 11/2018 | Taarning et al. |

FOREIGN PATENT DOCUMENTS

| | | | | |
|---|---|---|---|---|
| WO | WO-2014138810 | A1 * | 9/2014 | ..... C10G 17/00 |
| WO | WO 2015/141535 | A1 | 9/2015 | |
| WO | WO 2016/121747 | A1 | 8/2016 | |
| WO | WO 2018/003623 | A1 | 1/2018 | |
| WO | WO 2018/097108 | A1 | 5/2018 | |

OTHER PUBLICATIONS

Horaska et al., "Acrolein Provides Benefits and Solutions to Offshore Oilfield Production Problems." Society of Petroleum Engineers 2011, SPE (paper #) 146080.*
ISR for PCT/JP2019/043565, dated Dec. 10, 2019.
Written Opinion for PCT/JP2019/043565, dated Dec. 10, 2019.
"Petroleum Refining Process, New Edition", edited by the Japan Petroleum Institute, published by Kodansha Ltd., pp. 57, 85 (2014), ISBN978-4-06-154383-6. Discussed in specification as filed at paragraphs [0004] and [0007].

* cited by examiner

*Primary Examiner* — Daniel Berns
(74) *Attorney, Agent, or Firm* — GREENBLUM & BERNSTEIN, P.L.C.

(57) ABSTRACT

The present invention relates to a method for producing a hydrocarbon, including a step (Y) of converting a reaction product of at least one sulfur compound selected from the group consisting of hydrogen sulfide and a compound containing a —SH group which are contained in a hydrocarbon with an α,β-unsaturated aldehyde compound into a water-soluble compound in the presence of water, and a step (Z) of separating oil and water.

9 Claims, No Drawings

METHOD FOR HYDROCARBON PRODUCTION, PURIFICATION METHOD, AND PURIFIER

TECHNICAL FIELD

The present invention relates to a method for producing a hydrocarbon, a method for purifying a hydrocarbon, and a hydrocarbon purification apparatus.

BACKGROUND ART

Hydrocarbons such as fossil fuels and refined petroleum products such as natural gas, liquefied natural gas, sour gas, crude oil, naphtha, heavy aromatic naphtha, gasoline, kerosene, diesel oil, gas oil, heavy oil, FCC slurry, asphalt, and oil field concentrate often contain sulfur content, specifically sulfur compounds such as hydrogen sulfide and various compounds containing —SH groups (typically various mercaptans).

The sulfur compounds are combusted to produce sulfur dioxide and sulfur trioxide (collectively referred to as SOx), which are released into the atmosphere with flue gas and cause environmental pollution. Thus, the industry dealing with fossil fuels and refined petroleum products has had considerable cost and effort to reduce sulfur content to safe levels. For example, it is generally required that the sulfur content of marine fuel oil does not exceed 0.5%.

In order to solve the problem of reducing the sulfur content in hydrocarbons such as fossil fuels and refined petroleum products, for example, a method by a catalytic hydrodesulfurization method in which a feedstock oil is reacted with hydrogen at high temperature and high pressure using a catalyst has been proposed for a long time. However, a method for treating hydrocarbons such as heavy oil, which is mainly used for marine fuel oil, requires a high pressure, and nickel and vanadium contained in the heavy oil are easily deposited on the surface of a catalyst and become a catalyst poison. Therefore, there is a problem that the catalyst needs to be periodically replaced, and there is room for improvement (NPL 1).

On the other hand, as a method for removing a sulfur compound in a hydrocarbon, a method using a chemical such as a compound derived from an aldehyde such as triazine, formaldehyde or glyoxal has been proposed for a long time (for example, PTLs 1 and 2). However, in the case of such a method, only the sulfur compound in the hydrocarbon is converted into another compound, and the sulfur content cannot be removed from the hydrocarbon unless a separation operation is included.

CITATION LIST

Patent Literature

[PTL 1] U.S. Pat. No. 1,991,765
[PTL 2] U.S. Pat. No. 4,680,127

Non-Patent Literature

[NPL 1] "Petroleum Refining Process, New Edition" edited by the Japan Petroleum Institute, published by Kodansha Ltd., February 2014, p. 57, p. 85

SUMMARY OF INVENTION

Technical Problem

Therefore, an object of the present invention is to provide a method for removing a sulfur compound (hereinafter, also referred to as a sulfur content) from a hydrocarbon containing a sulfur compound such as hydrogen sulfide and a compound containing a —SH group without requiring a catalyst or severe conditions for hydrogenating the sulfur compound.

Solution to Problem

As a result of intensive studies, the present inventors have found that a sulfur content in a hydrocarbon can be removed by a method for producing a hydrocarbon, including a step (Y) of converting a reaction product of at least one sulfur compound selected from the group consisting of hydrogen sulfide and a compound containing a —SH group which are contained in a hydrocarbon with an α,β-unsaturated aldehyde compound into a water-soluble compound in the presence of water, and a step (Z) of separating oil and water, and have completed the present invention.

That is, the gist and configuration of the present invention are as follows.

[1] A method for producing a hydrocarbon, including a step (Y) of converting a reaction product of at least one sulfur compound selected from the group consisting of hydrogen sulfide and a compound containing a —SH group which are contained in a hydrocarbon with an α,β-unsaturated aldehyde compound into a water-soluble compound in the presence of water, and a step (Z) of separating oil and water.

[2] The method for producing a hydrocarbon as set forth in [1], further including a step (X) of bringing an α,β-unsaturated aldehyde compound into contact with the hydrocarbon containing the sulfur compound to obtain the reaction product.

[3] The method for producing a hydrocarbon as set forth in [1] or [2], wherein the step (X) is a step (X-1) of bringing an α,β-unsaturated aldehyde compound and an amine compound into contact with the hydrocarbon containing the sulfur compound to obtain the reaction product.

[4] The method for producing a hydrocarbon as set forth in [3], wherein the amine compound is a compound represented by the following general formula (1).

(1)

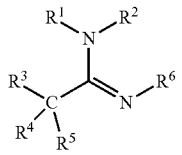

[5] The method for producing a hydrocarbon as set forth in any of [1] to [4], wherein the step (Y) is a step of reacting the reaction product with an aqueous sulfite solution to convert the reaction product into the water-soluble compound.

[6] The method for producing a hydrocarbon as set forth in [5], wherein the sulfite is at least one selected from the group consisting of sodium hydrogen sulfite, potassium hydrogen sulfite, ammonium hydrogen sulfite, sodium sulfite, potassium sulfite, and ammonium sulfite.

[7] The method for producing a hydrocarbon as set forth in [5] or [6], wherein the sulfite is sodium hydrogen sulfite.

[8] The method for producing a hydrocarbon as set forth in any of [5] to [7], wherein in the step (Y), the reaction product and the sulfite are brought into contact with each other such that the mass ratio of the reaction product to the sulfite is 1:1 to 1:400 to convert the reaction product into a water-soluble compound.

[9] The method for producing a hydrocarbon as set forth in any of [1] to [8], wherein the α,β-unsaturated aldehyde compound is at least one selected from the group consisting of acrolein, senecioaldehyde, and citral.

[10] A method for purifying a hydrocarbon, including a step (Y) of converting a reaction product of at least one sulfur compound selected from the group consisting of hydrogen sulfide and a compound containing a —SH group which are contained in a hydrocarbon with an α,β-unsaturated aldehyde compound into a water-soluble compound in the presence of water, and a step (Z) of separating oil and water.

[11] The method for purifying a hydrocarbon as set forth in [10], further including a step (X) of bringing an α,β-unsaturated aldehyde compound into contact with the hydrocarbon containing the sulfur compound to obtain the reaction product.

[12] A hydrocarbon purification apparatus including: a conversion apparatus that converts a reaction product of at least one sulfur compound selected from the group consisting of hydrogen sulfide and a compound containing a —SH group which are contained in a hydrocarbon with an α,β-unsaturated aldehyde compound into a water-soluble compound in the presence of water; and an oil-water separation apparatus that separates oil and water.

[13] The hydrocarbon purification apparatus as set forth in [12], further including a reaction apparatus that brings an α,β-unsaturated aldehyde compound into contact with the hydrocarbon containing the sulfur compound to obtain the reaction product.

Advantageous Effects of Invention

According to the present invention, it is possible to provide a method for removing a sulfur content from a hydrocarbon containing a sulfur compound such as hydrogen sulfide and a compound containing a —SH group without requiring a catalyst or severe conditions for hydrogenating the sulfur compound.

DESCRIPTION OF EMBODIMENTS

[Method for Producing Hydrocarbon]

The method for producing a hydrocarbon of the present invention includes a step (Y) of converting a reaction product of at least one sulfur compound selected from the group consisting of hydrogen sulfide and a compound containing a —SH group which are contained in a hydrocarbon with an α,β-unsaturated aldehyde compound into a water-soluble compound in the presence of water, and a step (Z) of separating oil and water.

According to the method for producing a hydrocarbon of the present invention, at least one sulfur compound selected from the group consisting of hydrogen sulfide and a compound containing a —SH group which are contained in the hydrocarbon can be removed from the hydrocarbon to produce the hydrocarbon that has been desulfurized.

In the present invention, the sulfur content can be removed by converting the sulfur compound contained in the hydrocarbon into a compound that can be more easily removed.

In the present invention, converting a sulfur compound contained in a hydrocarbon into another compound and separating the converted product from the hydrocarbon is defined as "removing a sulfur content".

<Step (Y)>

The step (Y) in the present invention is a step of converting a reaction product of at least one sulfur compound selected from the group consisting of hydrogen sulfide and a compound containing a —SH group which are contained in a hydrocarbon with an α,β-unsaturated aldehyde compound into a water-soluble compound in the presence of water.

In the step (Y), the reaction product of the sulfur compound and the α,β-unsaturated aldehyde compound is converted into a water-soluble compound in the presence of water, and can move from oil (oil phase) to water (water phase). Here, typically, the oil phase is mainly composed of the hydrocarbon, and the water phase is mainly composed of water. By separating the oil and water in the step (Z) described later, sulfur can be removed from the hydrocarbon as the oil.

(Reaction Product)

The reaction product of at least one sulfur compound selected from the group consisting of hydrogen sulfide and a compound containing a —SH group which are contained in a hydrocarbon with an α,β-unsaturated aldehyde compound in the present invention can be obtained by bringing the α,β-unsaturated aldehyde compound into contact with the hydrocarbon containing the sulfur compound. Examples of the reaction product include a sulfur compound adduct having an aldehyde group obtained by addition reaction of a sulfur compound to a carbon-carbon double bond of an α,β-unsaturated aldehyde compound.

(Hydrocarbon)

Examples of the hydrocarbon of the present invention is not particularly limited, and examples thereof include natural gas, liquefied natural gas (LNG), liquefied petroleum gas (LPG), dry gas, wet gas, oilfield gas, associated gas, crude oil, naphtha, heavy aromatic naphtha, gasoline, kerosene, diesel oil, gas oil, lubricating oil, heavy oil, A-type heavy oil, B-type heavy oil, C-type heavy oil, jet fuel oil, FCC slurry, asphalt, condensate, bitumen, extra heavy oil, tar, gas-to-liquid oil (GTL), coal-to-liquid oil (CTL), asphaltene, aromatic hydrocarbon, alkylate, base oil, kerogen, coke, black oil, synthetic crude oil, reformed gasoline, isomerized gasoline, regenerated heavy oil, residual oil, white oil, raffinate, cyclohexane, toluene, and xylene. The hydrocarbon may be of only one type or may contain two or more types.

The hydrocarbon used in the present invention may further contain other components such as water, an acid component and a metal component in addition to the sulfur compound described below.

The content of components other than the sulfur compound in the hydrocarbon is preferably 0.5% by mass or less, and more preferably 0.1% by mass or less, from the viewpoint of efficiently removing the sulfur content in the hydrocarbon.

(Sulfur Compound)

The sulfur compound in the present invention is at least one selected from the group consisting of hydrogen sulfide and compounds containing a —SH group.

The sulfur compound in the present invention does not include a reaction product with an α,β-unsaturated aldehyde compound. When a hydrocarbon containing a sulfur compound is contacted with an α,β-unsaturated aldehyde compound to obtain the aforementioned reaction product, it means the sulfur compound in the hydrocarbon before contacting the α,β-unsaturated aldehyde compound.

The sulfur compound may be only hydrogen sulfide, only a compound containing an —SH group, or a mixture thereof. The compound containing an —SH group is not particularly limited, and examples thereof include mercaptans represented by the chemical formula "R—SH" (where R represents an organic group). Examples of the mercaptans represented by the chemical formula "R—SH" include mercaptans in which R is an alkyl group, such as methyl mercaptan, ethyl mercaptan, n-propyl mercaptan, isopropyl mercaptan, n-butyl mercaptan, isobutyl mercaptan, sec-butyl mercaptan, tert-butyl mercaptan, and n-amyl mercaptan; mercaptans in which R is an aryl group, such as phenyl mercaptan; and mercaptans in which R is an aralkyl group, such as benzyl mercaptan. The compound containing an —SH group may be alone or in combination of two or more.

The content of the sulfur compound in the hydrocarbon is preferably 1 mass ppm or more, more preferably 4 mass ppm or more, and preferably 20% by mass or less, more preferably 10% by mass or less, still more preferably 1% by mass or less.

(α,β-Unsaturated Aldehyde Compound)

The α,β-unsaturated aldehyde compound used in the present invention is not particularly limited, and examples thereof include acrolein, senecioaldehyde, citral, crotonaldehyde, and methacrolein. These α,β-unsaturated aldehydes may be used alone, or two or more of these may be used in combination.

Among them, as the α,β-unsaturated aldehyde, acrolein, senecioaldehyde and citral are preferable from the viewpoint of efficiently removing the sulfur content in the hydrocarbon, and senecioaldehyde and citral are more preferable from the viewpoint of low toxicity, biodegradability, handling safety, heat resistance, low metal corrosiveness and the like, and senecioaldehyde is still more preferable.

(Water-Soluble Compound)

The water-soluble compound in the present invention is obtained by converting a reaction product of at least one sulfur compound selected from the group consisting of hydrogen sulfide and compounds containing a —SH group with an α,β-unsaturated aldehyde compound in the presence of water. The method of conversion is not particularly limited, but, for example, from the viewpoint of improving the effect of removing sulfur, it is preferable to use an aqueous sulfite solution and react the reaction product with the aqueous sulfite solution. Accordingly, the reaction product can be converted into a salt by reacting the reaction product with a sulfite.

Specific examples of the sulfite contained in the aqueous sulfite solution include sodium hydrogen sulfite, potassium hydrogen sulfite, ammonium hydrogen sulfite, sodium sulfite, potassium sulfite, and ammonium sulfite. Among them, sodium hydrogen sulfite is preferable from the viewpoint of reactivity.

These sulfites may be used alone, or two or more of these may be used in combination. The sulfite may be a commercially available product or may be produced by a known method.

When the reaction product is converted into a water-soluble compound using an aqueous sulfite solution, the content of the sulfite in the aqueous sulfite solution can be appropriately set depending on the type of hydrocarbon, the type and content of sulfur compound, temperature conditions, and the like, but the content of the sulfite is preferably 0.1% by mass or more, more preferably 5% by mass or more, and still more preferably 10% by mass or more, and the content that becomes a saturated aqueous solution is yet still more preferable. For example, when sodium hydrogen sulfite is used as the sulfite, the content of sodium hydrogen sulfite in the saturated aqueous solution at 25° C. is 30% by mass.

The aqueous sulfite solution may further contain other components such as a corrosion inhibitor, an oxygen scavenger, an iron control agent, a breaker, a temperature stabilizer, a pH adjusting agent, a dehydration adjusting agent, a swelling inhibitor, a scale inhibitor, a biocide, a friction reducing agent, an anti-foaming agent, a lost circulation material, a lubricant, a clay dispersant, a weighting agent, and a nitrogen-containing compound, as long as the effects of the present invention are not impaired.

The content of components other than sulfite in the sulfite aqueous solution is preferably 0 to 10% by mass, more preferably 0 to 5% by mass.

When the reaction product is converted into a water-soluble compound using an aqueous sulfite solution, the mass ratio of the reaction product to the sulfite is preferably 1:1 to 1:400, more preferably 1:2 to 1:300, and still more preferably 1:10 to 1:200, from the viewpoint of improving the effect of removing the sulfur content.

Within the above range, both the efficiency of removing sulfur compounds and the productivity can be achieved.

In the step (Y), the temperature at which the reaction product is converted into a water-soluble compound in the presence of water is preferably 5° C. or higher, more preferably 10° C. or higher, and still more preferably 15° C. or higher, and is preferably 100° C. or lower, more preferably 70° C. or lower, and still more preferably 50° C. or lower.

<Step (Z)>

Step (Z) in the present invention is a step of separating oil (oil phase) and water (water phase).

After the reaction product is converted into a water-soluble compound in the presence of water, in the step (Z), the oil and water may be immediately separated from each other, or the oil and water may be separated from each other after a lapse of a predetermined time. In the present invention, the method for separating oil and water is not particularly limited, and examples thereof include a method by standing, a method by centrifugation, and a method using an oil-water separation apparatus.

<Step (X)>

In one embodiment of the present invention, the method for producing a hydrocarbon of the present invention may include a step (X) of bringing an α,β-unsaturated aldehyde compound into contact with a hydrocarbon containing a sulfur compound to obtain the reaction product before the step (Y).

In the step (X), when the α,β-unsaturated aldehyde compound is brought into contact with the hydrocarbon containing the sulfur compound, the α,β-unsaturated aldehyde compound is preferably brought into contact with the hydrocarbon containing the sulfur compound such that the amount of the α,β-unsaturated aldehyde compound is preferably 1 mol or more, and more preferably 3 mol or more, with respect to 1 mol of the sulfur compound.

In the step (X), the temperature at which the α,β-unsaturated aldehyde compound is brought into contact with the hydrocarbon containing the sulfur compound may be 50° C. or lower in the case of acrolein. At this temperature or lower, acrolein does not become a gas at normal pressure, and polymerization reaction is hard to occur, making it easy to handle.

In addition, in the case of an α,β-unsaturated aldehyde compound other than acrolein, such as senecioaldehyde, the temperature is not particularly limited, but is preferably −40° C. or higher, more preferably 0° C. or higher, and still more preferably 5° C. or higher, and is preferably 200° C. or lower, more preferably 150° C. or lower, and still more preferably 100° C. or lower.

In the step (X), when the α,β-unsaturated aldehyde compound is brought into contact with the hydrocarbon containing a sulfur compound, a component other than the α,β-unsaturated aldehyde compound may be used as long as the effects of the present invention are not impaired. Examples of the other components include a corrosion inhibitor, an oxygen scavenger, an iron control agent, a breaker, a temperature stabilizer, a pH adjusting agent, a dehydration adjusting agent, a swelling inhibitor, a scale inhibitor, a biocide, a friction reducing agent, an anti-foaming agent, a lost circulation material, a lubricant, a clay dispersant, a weighting agent, and a nitrogen-containing compound. After the other components and the α,β-unsaturated aldehyde compound are mixed in advance, the mixture may be brought into contact with the hydrocarbon containing the sulfur compound, or the α,β-unsaturated aldehyde compound and the other components may be individually brought into contact with the hydrocarbon containing the sulfur compound.

The step (X) is preferably a step (X-1) of bringing an α,β-unsaturated aldehyde compound and an amine compound into contact with a hydrocarbon containing a sulfur compound to obtain the reaction product.

The amine compound preferably has a pKa value of 11.3 or more, more preferably 11.4 or more, and still more preferably 11.5 or more. By using the amine compound having the pKa as described above, the removal efficiency of the sulfur compound is improved.

Here, the pKa value (the value of the acid dissociation constant (pKa) of the conjugate acid at 25° C. in water) may be measured using any appropriate measuring device, and can also be known from the literature such as "CRC HANDBOOK of CHEMISTRY and PHYSICS". Specific examples of the measurement method include a method of measuring the hydrogen ion concentration using a pH meter and calculating from the concentration of the relevant substance and the hydrogen ion concentration.

As the amine compound, for example, a compound having an amidine skeleton or a guanidine skeleton is preferable, and specific examples thereof include compounds represented by the following general formula (1) or the following general formula (2), and the compound represented by the general formula (1) is preferable.

(1)

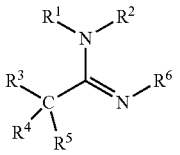

(2)

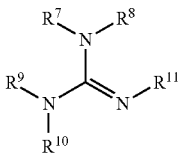

In the general formulae (1) and (2), $R^1$ to $R^{11}$ each independently represent a hydrogen atom or an alkyl group having 1 to 5 carbon atoms. However, $R^1$ and $R^3$, or $R^2$ and $R^6$, or $R^7$ and $R^9$, or $R^8$ and $R^{11}$ may be connected to each other to form an alkylene group having 2 to 6 carbon atoms.

Examples of the compound represented by the general formula (1) include 1,8-diazabicyclo[5.4.0]undec-7-ene (DBU) and 1,5-diazabicyclo[4.3.0]non-5-ene (DBN).

Examples of the compound represented by the general formula (2) include guanidine, 1,1,3,3-tetramethylguanidine (TMG), 1,5,7-triazabicyclo[4.4.0]dec-5-ene (TBD), and 7-methyl-1,5,7-triazabicyclo[4.4.0]dec-5-ene (MTBD).

These amine compounds may be used alone, or two or more of these may be used in combination.

The amine compound may be a commercially available product or may be produced by a known method.

The ratio of the amount of the α,β-unsaturated aldehyde compound to the amine compound used in the step (X-1) is usually A:B=0.1:99.9 to 99.9:0.1, where the α,β-unsaturated aldehyde compound is A (part by mass) and the amine compound is B (part by mass). From the standpoint of cost-effectiveness, the ratio is preferably A:B=20:80 to 99.5:0.5, more preferably A:B=40:60 to 99:1, and still more preferably A:B=41:59 to 85:15.

In the step (X-1), the temperature at which the α,β-unsaturated aldehyde compound and the amine compound are brought into contact with the hydrocarbon containing a sulfur compound is not particularly limited, but is preferably −40° C. or higher, more preferably 0° C. or higher, and still more preferably 5° C. or higher, and is preferably 200° C. or lower, more preferably 150° C. or lower, and still more preferably 100° C. or lower.

In the step (X-1), the method of bringing the α,β-unsaturated aldehyde compound and the amine compound into contact with the hydrocarbon containing the sulfur compound is not particularly limited, and examples thereof include: (I) a method of separately adding an α,β-unsaturated aldehyde compound, an amine compound, and optionally the above-described other components to a hydrocarbon containing a sulfur compound and mixing them in the hydrocarbon containing a sulfur compound; (II) a method of mixing an α,β-unsaturated aldehyde compound and an amine compound in advance, adding them to a hydrocarbon containing a sulfur compound, and optionally further adding the above-described other components to the hydrocarbon containing a sulfur compound and mixing them; and (III) a method of mixing an α,β-unsaturated aldehyde compound, an amine compound, and optionally the above-described other components in advance, and adding them to a hydrocarbon containing a sulfur compound.

Among them, the above methods (II) and (III) are preferable from the viewpoint of ease of handling and the like.

[Method for Purifying Hydrocarbon]

The method for purifying a hydrocarbon of the present invention includes a step (Y) of converting a reaction product of at least one sulfur compound selected from the group consisting of hydrogen sulfide and a compound containing a —SH group which are contained in a hydrocarbon with an α,β-unsaturated aldehyde compound into a water-soluble compound in the presence of water, and a step (Z) of separating oil and water.

According to the method for purifying a hydrocarbon of the present invention, at least one sulfur compound selected from the group consisting of hydrogen sulfide and a compound containing a —SH group which are contained in the hydrocarbon can be removed from the hydrocarbon to purify the hydrocarbon by the same method as the above-described method for producing a hydrocarbon, and the details and preferred embodiments thereof are the same as those of the method for producing a hydrocarbon.

The method for purifying a hydrocarbon of the present invention preferably includes a step (X) of bringing an α,β-unsaturated aldehyde compound into contact with the hydrocarbon containing a sulfur compound to obtain the reaction product.

[Hydrocarbon Purification Apparatus]

The hydrocarbon purification apparatus of the present invention includes a conversion apparatus of converting a reaction product of at least one sulfur compound selected from the group consisting of hydrogen sulfide and a compound containing a —SH group which are contained in a hydrocarbon with an α,β-unsaturated aldehyde compound into a water-soluble compound in the presence of water, and an oil-water separation apparatus of separating oil and water.

The hydrocarbon purification apparatus of the present invention relates to an apparatus for carrying out the above-mentioned method for producing a hydrocarbon, and the purification apparatus enables desulfurization of a hydrocarbon containing a sulfur compound.

The hydrocarbon purification apparatus of the present invention preferably includes a reaction apparatus for obtaining the reaction product by bringing an α,β-unsaturated aldehyde compound into contact with the hydrocarbon containing the sulfur compound.

Although the embodiments of the present invention have been described above, the present invention is not limited to the above-described embodiments, and includes all aspects included in the concept of the present invention and the scope of claims, and can be variously modified within the scope of the present invention.

EXAMPLES

Hereinafter, the present invention will be described in detail with reference to Examples, but the present invention is not limited to these examples. Various materials used in Examples and Comparative Examples are shown below.

[Hydrocarbon]

Crude oil: manufactured by Japan Petroleum Exploration Co., Ltd., density=0.8 g/cm$^3$ Kerosene: manufactured by FUJIFILM Wako Pure Chemical Corporation, density=0.8 g/cm$^3$ Toluene: manufactured by FUJIFILM Wako Pure Chemical Corporation, density=0.87 g/cm$^3$

[Sulfur Compound]

Hydrogen sulfide ($H_2S$) gas: manufactured by Taiyo Nippon Sanso Corporation, purity>99.99% by volume Ethyl mercaptan (EtSH): manufactured by FUJIFILM Wako Pure Chemical Corporation, density=0.84 g/cm$^3$

[α,β-Unsaturated Aldehyde Compound]

Acrolein: manufactured by Tokyo Chemical Industry Co., Ltd., purity>95% by mass, containing hydroquinone as a stabilizer, density=0.84 g/cm$^3$ Senecioaldehyde (SAL): synthesized from prenol according to the method described in JP 60-224652 A (purity: 98.1% by mass), density=0.87 g/cm$^3$

[Sulfite]

Sodium hydrogen sulfite ($NaHSO_3$): manufactured by FUJIFILM Wako Pure Chemical Corporation

[Amine Compound]

1,8-diazabicyclo[5.4.0]undec-7-ene (DBU): manufactured by FUJIFILM Wako Pure Chemical Corporation, pKa=11.5, density=1.02 g/cm$^3$

Example 1

Step (X)

Crude oil was added to a 100-mL three-necked flask, and $H_2S$ gas was blown into the flask at a rate of 10 mL/min for 30 minutes to obtain $H_2S$-containing crude oil. Subsequently the $H_2S$-containing crude oil and the crude oil were placed in a sample tube such that the $H_2S$ concentration was 938 mass ppm ($H_2S$ concentration: 1000 mass ppm, 1.20 mmol) in terms of sulfur atoms to obtain 50 mL of a crude oil solution containing a sulfur compound.

Next, 250 μL (3.74 mmol) of acrolein was added to the above crude oil solution, and the solution was stirred at room temperature (20° C.±5° C., the same applies below) at 800 rpm to react the sulfur compound with acrolein, thereby obtaining a treated liquid.

One day after the reaction, the $H_2S$ concentration of the treated liquid was measured. As a result, the $H_2S$ concentration was 49 mass ppm in terms of sulfur atoms, and the conversion rate of sulfur compounds into sulfur compound adducts was 95%.

Step (Y)

10 mL of the above treated liquid was added to a sample tube, 10 mL of a saturated aqueous solution of sodium hydrogen sulfite (temperature: 25° C.) was added thereto, and the mixture was stirred at room temperature under 800 rpm for 30 minutes to convert the reaction product of the sulfur compound and acrolein into a water-soluble compound.

Step (Z)

The oil and water were separated by allowing to stand at room temperature for 1 hour, and the sulfur content of the oil in the sample tube was measured. As a result, the sulfur content concentration derived from $H_2S$ was 50 mass ppm in terms of sulfur atoms, and the removal rate of the sulfur content in the hydrocarbon (in terms of sulfur atoms) was 95%.

The sulfur content concentration (in terms of sulfur atoms) was measured by gas chromatography analysis using a calibration curve method. The gas chromatography analysis was performed under the following conditions.

(Gas Chromatography Analysis)

Analytical instrument: GC-SCD (manufactured by Agilent Technologies, Inc.)

Detector: SCD (Sulfur Chemiluminescence Detector)

Column used: DB-sulfur SCD (length: 60 m, film thickness: 4.2 μm, inner diameter: 0.32 mm) (manufactured by Agilent Technologies, Inc.)

Analysis conditions: Inject. Temp. 250° C., Detect. Temp. 250° C.

Temperature rise conditions: 35° C. (held for 3 minutes)→(temperature rise at 20° C./min)→250° C. (held for 15 minutes)

Internal standard: diphenyl sulfide

Example 2

The procedure was the same as in Example 1, except that 250 μL (2.59 mmol) of SAL was used instead of 250 μL of acrolein, 250 μL (1.71 mmol) of DBU was used as an amine compound, and the standing time at room temperature for separating oil and water was changed to 5 minutes. The results are shown in Table 1.

Comparative Example 1

The procedure was the same as in Example 2, except that distilled water was used instead of the saturated aqueous solution of sodium hydrogen sulfite. The results are shown in Table 1.

Example 3

The same removal operation as in Example 2 was performed except that EtSH was used instead of $H_2S$, and a crude oil solution containing sulfur compounds having an EtSH concentration of 530 mass ppm (EtSH concentration: 0.66 mmol) in terms of sulfur atoms was prepared. The results are shown in Table 1.

Comparative Example 2

The procedure was the same as in Example 3, except that distilled water was used instead of the saturated aqueous solution of sodium hydrogen sulfite. The results are shown in Table 1.

Example 4

The procedure was the same as in Example 3, except that kerosene was used instead of crude oil. The results are shown in Table 1.

Example 5

The procedure was the same as in Example 3, except that toluene was used instead of crude oil. The results are shown in Table 1.

TABLE 1

| | Step (X), (X-1) | | | | | Step (Y) | |
|---|---|---|---|---|---|---|---|
| | α,β-unsaturated aldehyde compound | Sulfur compound | Hydrocarbon | Amine Compound | Sulfur compound conversion rate (%)*1 | Salt | Sulfur content removal rate (%)*2 |
| Example 1 | acrolein | $H_2S$ | crude oil | — | 95 | $NaHSO_3$ | 95 |
| Example 2 | SAL | $H_2S$ | crude oil | DBU | 91 | $NaHSO_3$ | 91 |
| Comparative Example 1 | SAL | $H_2S$ | crude oil | DBU | 91 | — | 15 |
| Example 3 | SAL | EtSH | crude oil | DBU | 82 | $NaHSO_3$ | 81 |
| Comparative Example 2 | SAL | EtSH | crude oil | DBU | 82 | — | <10 |
| Example 4 | SAL | EtSH | kerosene | DBU | 83 | $NaHSO_3$ | 92 |
| Example 5 | SAL | EtSH | toluene | DBU | 73 | $NaHSO_3$ | 81 |

*1: Sulfur compound conversion rate (in terms of sulfur atoms)
*2: Sulfur content removal rate in hydrocarbon (in terms of sulfur atoms)

As shown in Table 1, it was confirmed that the sulfur content contained in the hydrocarbon can be removed by the step including the step (Y) of bringing the aqueous sulfite solution into contact with the treated liquid obtained by bringing the α,β-unsaturated aldehyde compound into contact with the hydrocarbon containing the sulfur compound and the step (Z) of separating oil and water.

The invention claimed is:

1. A method for producing a hydrocarbon, comprising:

converting a reaction product of at least one sulfur compound selected from the group consisting of hydrogen sulfide and a compound containing a —SH group which are contained in a hydrocarbon with an α,β-unsaturated aldehyde compound other than acrolein into a water-soluble compound in the presence of water to obtain a solution comprising an oil phase and a water phase, and separating the oil phase from the water phase in the solution.

2. The method for producing a hydrocarbon according to claim 1, further comprising bringing the α,β-unsaturated aldehyde compound and an amine compound into contact with the hydrocarbon containing the sulfur compound to obtain the reaction product.

3. The method for producing a hydrocarbon according to claim 2, wherein the amine compound is a compound of formula (1):

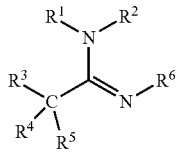

(1)

where:

$R^1$ to $R^6$ each independently represents a hydrogen atom or an alkyl group having 1 to 5 carbon atoms, wherein:

$R^1$ and $R^3$ are optionally connected to each other to form an alkylene group having 2 to 6 carbon atoms; and $R^2$ and $R^6$ are optionally connected to each other to form an alkylene group having 2 to 6 carbon atoms.

4. The method for producing a hydrocarbon according to claim 1, wherein the converting the reaction product comprises reacting the reaction product with an aqueous sulfite solution to convert the reaction product into the water-soluble compound.

5. The method for producing a hydrocarbon according to claim 4, wherein the sulfite is at least one selected from the group consisting of sodium hydrogen sulfite, potassium hydrogen sulfite, ammonium hydrogen sulfite, sodium sulfite, potassium sulfite, and ammonium sulfite.

6. The method for producing a hydrocarbon according to claim 4, wherein the sulfite is sodium hydrogen sulfite.

7. The method for producing a hydrocarbon according to claim 4, wherein the reaction product and the sulfite are brought into contact with each other such that a mass ratio of the reaction product to the sulfite is 1:1 to 1:400.

8. The method for producing a hydrocarbon according to claim 1, wherein the α,β-unsaturated aldehyde compound is at least one selected from the group consisting of senecioaldehyde and citral.

9. A method for purifying a hydrocarbon, comprising:

converting a reaction product of at least one sulfur compound selected from the group consisting of hydrogen sulfide and a compound containing a —SH group which are contained in a hydrocarbon with an α,β-unsaturated aldehyde compound other than acrolein into a water-soluble compound in the presence of water to obtain a solution comprising an oil phase and a water phase, and separating the oil phase from the water phase in the solution.

* * * * *